US010867768B2

(12) United States Patent
Mane et al.

(10) Patent No.: US 10,867,768 B2
(45) Date of Patent: Dec. 15, 2020

(54) ENHANCED ELECTRON AMPLIFIER STRUCTURE AND METHOD OF FABRICATING THE ENHANCED ELECTRON AMPLIFIER STRUCTURE

(71) Applicant: UCHICAGO ARGONNE, LLC, Chicago, IL (US)

(72) Inventors: Anil U. Mane, Naperville, IL (US); Jeffrey W. Elam, Elmhurst, IL (US)

(73) Assignee: UChicago Argonne, LLC, Chicago, IL (US)

( * ) Notice: Subject to any disclaimer, the term of this patent is extended or adjusted under 35 U.S.C. 154(b) by 65 days.

(21) Appl. No.: 15/691,633

(22) Filed: Aug. 30, 2017

(65) Prior Publication Data

US 2019/0066961 A1 Feb. 28, 2019

(51) Int. Cl.

| | |
|---|---|
| ***H01J 1/32*** | (2006.01) |
| ***H01J 9/12*** | (2006.01) |
| ***H01J 43/24*** | (2006.01) |
| ***H01J 43/04*** | (2006.01) |

(52) U.S. Cl.

CPC ..... *H01J 1/32* (2013.01); *H01J 9/125* (2013.01); *H01J 43/04* (2013.01); *H01J 43/246* (2013.01); *H01J 2209/012* (2013.01)

(58) Field of Classification Search

CPC ..... H01L 1/32

See application file for complete search history.

(56) References Cited

U.S. PATENT DOCUMENTS

| | | | | |
|---|---|---|---|---|
| 4,978,885 A * | 12/1990 | White | ..... | H01J 9/445 313/103 CM |
| 5,359,187 A * | 10/1994 | Weiss | ..... | H01J 31/507 250/214 VT |
| 9,177,764 B1 | 11/2015 | Baney | | |
| 2003/0205956 A1 | 11/2003 | Downing et al. | | |

(Continued)

FOREIGN PATENT DOCUMENTS

| | | | |
|---|---|---|---|
| FR | 2053599 A5 | | 4/1971 |
| WO | WO 2013/168968 | * | 11/2013 |

OTHER PUBLICATIONS

Machine translation of document N.*

(Continued)

*Primary Examiner* — Austin Murata

(74) *Attorney, Agent, or Firm* — Foley & Lardner LLP

(57) ABSTRACT

An enhanced electron amplifier structure includes a microporous substrate having a front surface and a rear surface, the microporous substrate including at least one channel extending substantially through the substrate between the front surface and the rear surface, an ion diffusion layer formed on a surface of the channel, the ion diffusion layer comprising a metal oxide, a resistive coating layer formed on the first ion diffusion layer, an emissive coating layer formed on the resistive coating layer, and an optional ion feedback layer formed on the front surface of the structure. The emissive coating produces a secondary electron emission responsive to an interaction with a particle received by the channel. The ion diffusion layer, the resistive coating layer, the emissive coating layer, and the ion feedback layer are independently deposited via chemical vapor deposition or atomic layer deposition.

10 Claims, 11 Drawing Sheets

(56) References Cited

U.S. PATENT DOCUMENTS

| | | | | |
|---|---|---|---|---|
| 2009/0315443 | A1* | 12/2009 | Sullivan | H01J 43/04 313/103 CM |
| 2012/0025090 | A1 | 2/2012 | Diawara | |
| 2012/0273689 | A1 | 11/2012 | Sullivan et al. | |

OTHER PUBLICATIONS

Duanmu, Q., et al., "Effects of Ion Barrier Film on Image Noise in Generation III Image Tube," International Conference on Optoelectronics and Microelectronics, Aug. 23-25, 2012, pp. 549-552.

Jiang, D., et al., "Electron transmittance characteristics of MCP ion barrier film," Proceedings of SPIE, vol. 5633, Advanced Materials and Devices for Sensing and Imaging II, Jan. 20, 2005, pp. 443-446.

Zhang, N., et al., "The Research on Preparation Process Optimization of Ion Barrier Film on the Input Side of MCP," Key Engineering Materials, vol. 552, May 27, 2013, pp. 186-192.

Prodanovic, et al., "Effect of thermal annealing and chemical treatments on secondary electron emission properties of atomic layer deposited MgO," Journal of Vacuum Science & Technology A 36(6), 06A102, 9 pages (2018).

Van Der Graaf, et al., "The Tynode: A new vacuum electron multiplier," Nuclear Instruments and Methods in Physics Research A 847, pp. 148-161 (2017).

Macarthur, D.W., "A neutron detector based on microchannel plates," Jun. 1987, Los Alamos National Laboratory, pp. 1-6.

* cited by examiner

ENHANCED ELECTRON AMPLIFIER STRUCTURE AND METHOD OF FABRICATING THE ENHANCED ELECTRON AMPLIFIER STRUCTURE

STATEMENT OF GOVERNMENT INTEREST

The United States Government claims certain rights in this invention pursuant to Contract No. DE-AC02-06CH11357 between the U.S. Department of Energy and UChicago Argonne, LLC, as operator of Argonne National Laboratories.

FIELD OF THE INVENTION

The present invention relates generally to the field of fabricating enhanced electron amplifier structures. More specifically, the present invention relates to forming an ion feedback layer on walls of a channel in an electron amplifier structure and/or a top surface of an electron amplifier structure.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

An electron amplifier structure or an electron multiplier may be used as a component in a detector system to detect low levels of electrons, ions, or photons, and provide an amplified response via a plurality of secondary electron emissions. Conventional electron amplifier structures such as channeltrons (single channel tubes) and microchannel plates (MCPs, 2D arrays of micro channels) are generally fabricated using various types of glass such as lead glass. During fabrication of these electron amplifier structures, the microchannel inner wall glass surface undergoes etching and cleaning steps. During these steps, the inner wall glass surface becomes roughened and acquires a higher affinity for adsorbed gases. The roughness imparts a higher surface area, and together with the greater affinity for adsorption, a larger quantity of residual gaseous species including $O_2$, $H_2O$, $H_2$, $N_2$, CO, and $CO_2$, become trapped within the structure. Under operation, these gaseous species can be released through electron stimulated desorption and become ionized with a positive charge. These ions are accelerated in a direction opposite that of the amplified electrons, and can strike the channel wall and liberate electrons which become amplified. As a result, ion feedback noise is introduced in the detected signal, the electron amplifier structure/detection device's performance can be affected, and/or the electron amplifier structure/detection device may be damaged.

An additional source of ion feedback originates from alkali metal ions present in the glass such as $Ca^+$, $Na^+$, $K^+$, $Cs^+$, $Rb^+$, and $B^+$. Through processes of electromigration and surface energy minimization, these ions can accumulate on or near the channel wall surfaces. Amplified electrons impinging on the channel walls can release these alkali metal ions through electron stimulated desorption. These alkali metal ions are then accelerated in a direction opposite that of the amplified electrons, and can strike the channel wall and liberate electrons which become amplified. Gaseous positive ions, whether they originate from residual gases or alkali metal ions in the glass, are especially dangerous in photodetectors as they are accelerated toward the sensitive photocathode and can damage the sensitive photocathode layer, thus compromising the photoemissive property of the photocathode material.

Recent advances in electron amplifier structure fabrication methods such as thin film functionalization of template substrates or the semiconductor device fabrication approach to fabricated channels for electron amplification will also experience similar ion feedback issues for similar reasons, in addition to the degassing of functionalized thin film materials which are deposited on the channel wall. Again under high electric field operation, as the secondary electron emissions (i.e., electron avalanche) multiply through a microchannel (driven by the bias voltage across the channels), ions can be produced. These ions are then accelerated and travel in the opposite direction and impact the walls releasing additional electrons. This ion feedback problem can damage the amplifier structure as well as photocathodes or phosphor screens.

A need exists for improved technology, including an enhanced electron amplifier structure including an ion diffusion layer and an ion feedback layer, and a method of fabricating the enhanced electron amplifier structure.

SUMMARY

One embodiment of the invention relates to an enhanced electron amplifier structure includes a microporous substrate having a front surface and a rear surface, the microporous substrate including at least one channel extending substantially through the substrate between the front surface and the rear surface, a first ion feedback layer formed on a surface of the channel, the ion feedback layer comprising a metal oxide, a resistive coating layer formed on the first ion feedback layer, and an emissive coating layer formed on the resistive coating layer. The emissive coating produces a secondary electron emission responsive to an interaction with a particle received by the channel. The first ion feedback layer, the resistive coating layer, and the emissive coating layer are independently deposited via chemical vapor deposition or atomic layer deposition.

Another embodiment of the invention relates to a method of fabricating an enhanced electron amplifier structure. The method includes providing a microporous substrate, the microporous substrate having a front surface and a rear surface and at least one channel extending through the microporous substrate between the front surface and the rear surface, depositing a surface of the channel within the microporous substrate with a first ion feedback layer comprising a metal oxide, depositing a surface of the first ion feedback layer with a resistive coating layer, and depositing a surface of the resistive coating layer with an emissive coating layer, the emissive coating configured to produce a secondary electron emission responsive to an interaction with a particle received by the channel. The first ion feedback layer, the resistive coating layer, and the emissive coating layer are independently deposited via chemical vapor deposition or atomic layer deposition.

Yet another embodiment of the invention relates to a method of fabricating an enhanced electron amplifier structure. The method includes providing a microporous substrate, the microporous substrate having a front surface and a rear surface and at least one channel extending through the microporous substrate between the front surface and the rear surface, depositing a surface of the channel within the microporous substrate with a first ion feedback layer comprising a metal oxide, depositing a surface of the first ion feedback layer with a resistive coating layer, depositing a surface of the resistive coating layer with an emissive coating layer, the emissive coating configured to produce a secondary electron emission responsive to an interaction with a particle received by the channel, and depositing an ion feedback layer on the front surface of the microporous substrate. Depositing the ion feedback layer includes forming the ion feedback layer on a substrate in a predetermined thickness, lifting the ion feedback layer from the substrate, and transferring the ion feedback layer onto the upper surface of the microporous substrate.

Another embodiment of the invention relates to a method of fabricating an enhanced electron amplifier structure. The method includes providing a microporous substrate, the microporous substrate having a front surface and a rear surface and at least one channel extending through the microporous substrate between the front surface and the rear surface, and depositing an ion feedback layer on the front surface of the microporous substrate. Depositing the ion feedback layer includes forming the ion feedback layer on a substrate in a predetermined thickness, lifting the ion feedback layer from the substrate, and transferring the ion feedback layer onto the upper surface of the microporous substrate.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

An MCP is comprised of an array of narrow pores in a flat plate that permeate from the front surface of the plate to the back surface of the plate. For example, the MCP may be a two dimensional array comprised of millions of 5-20 μm diameter pores. A high voltage is applied across the plate such that the back surface is typically at 1000 V higher potential than the front surface. An electron enters the front of an MCP into a channel, and impinges on the channel wall causing secondary electron emissions to be produced by an emissive layer on the channel surface. These secondary electrons are accelerated towards the back of the plate by the high voltage bias and impact on the channel wall to produce additional secondary electrons resulting in a cascading increase in electrons along the length of the MCP channel that exit the opposite end of the channel. Since the MCP pores operate independently, a spatial pattern of electrons incident on the front surface will be preserved so that the back surface emits the same pattern but greatly amplified. In this way, the MCP may be used in imaging applications. Two or more MCPs may be placed in series to provide multiple stages of amplification. Various detectors may be located downstream of the MCP to detect and record the exiting electrons. A photocathode located upstream of the MCP can be used to convert photons incident on the front surface of the photocathode into electrons which exit the back surface and impinge on the MCP to yield a photodetector. MCP-based photodetectors can provide excellent temporal and spatial resolution, very high gain, and significantly low background signal with usability inside magnetic fields as well as cryogenic temperatures with extended life time.

Figure 1:
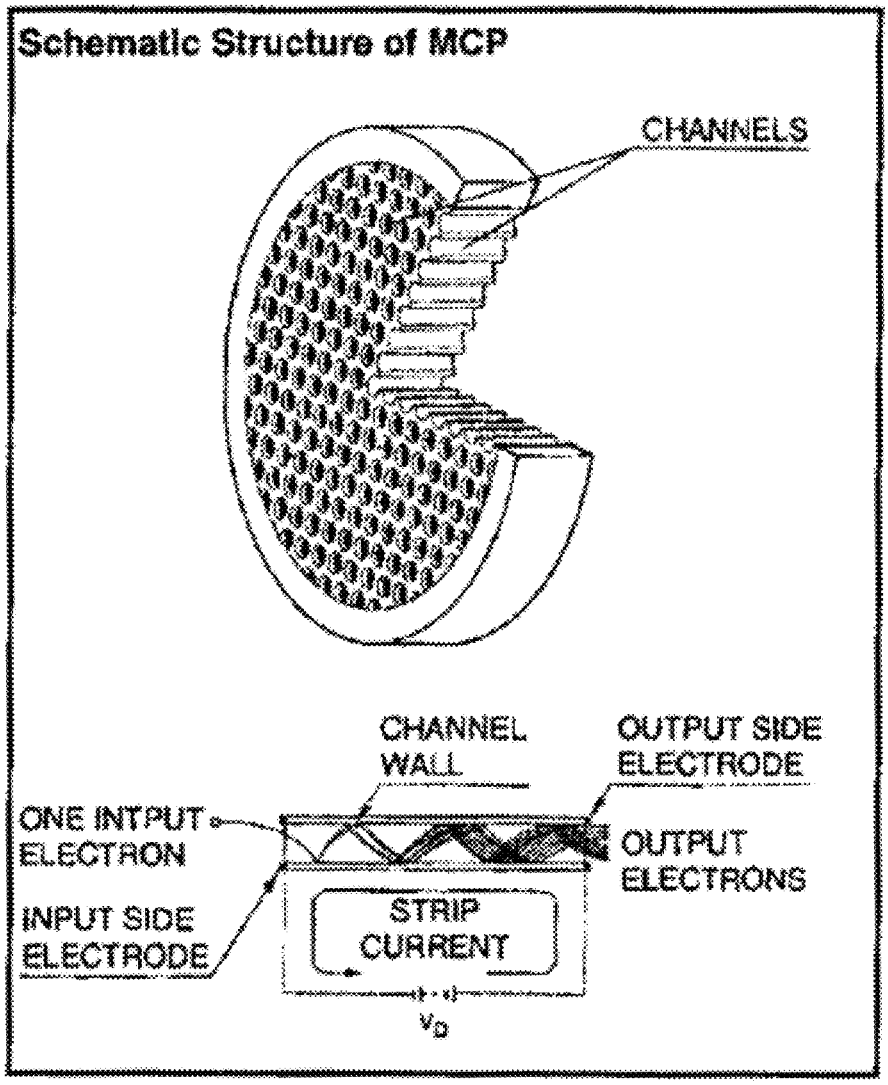
FIG. 1 (Prior Art)
FIG. 1 is a schematic of a conventional MCP plate and configuration of a channel within the MCP.

FIG. 1 depicts a configuration of a conventional MCP detector. MCPs may be prepared with various dimensions and shapes but often are circular and have a diameter of about 3 to 10 cm and a thickness on the order of about 1 mm. The MCP disc is generally fabricated from highly resistive glass by heating and drawing composite glass fiber bundles comprising a core glass material and a cladding glass material. The fiber bundles are then cut into thin discs and polished, after which the core material is etched away to leave a microporous plate. Typically, the microporous plate is activated by annealing in hydrogen and then metal electrodes are deposited on both sides to produce an MCP.

Figure 3:
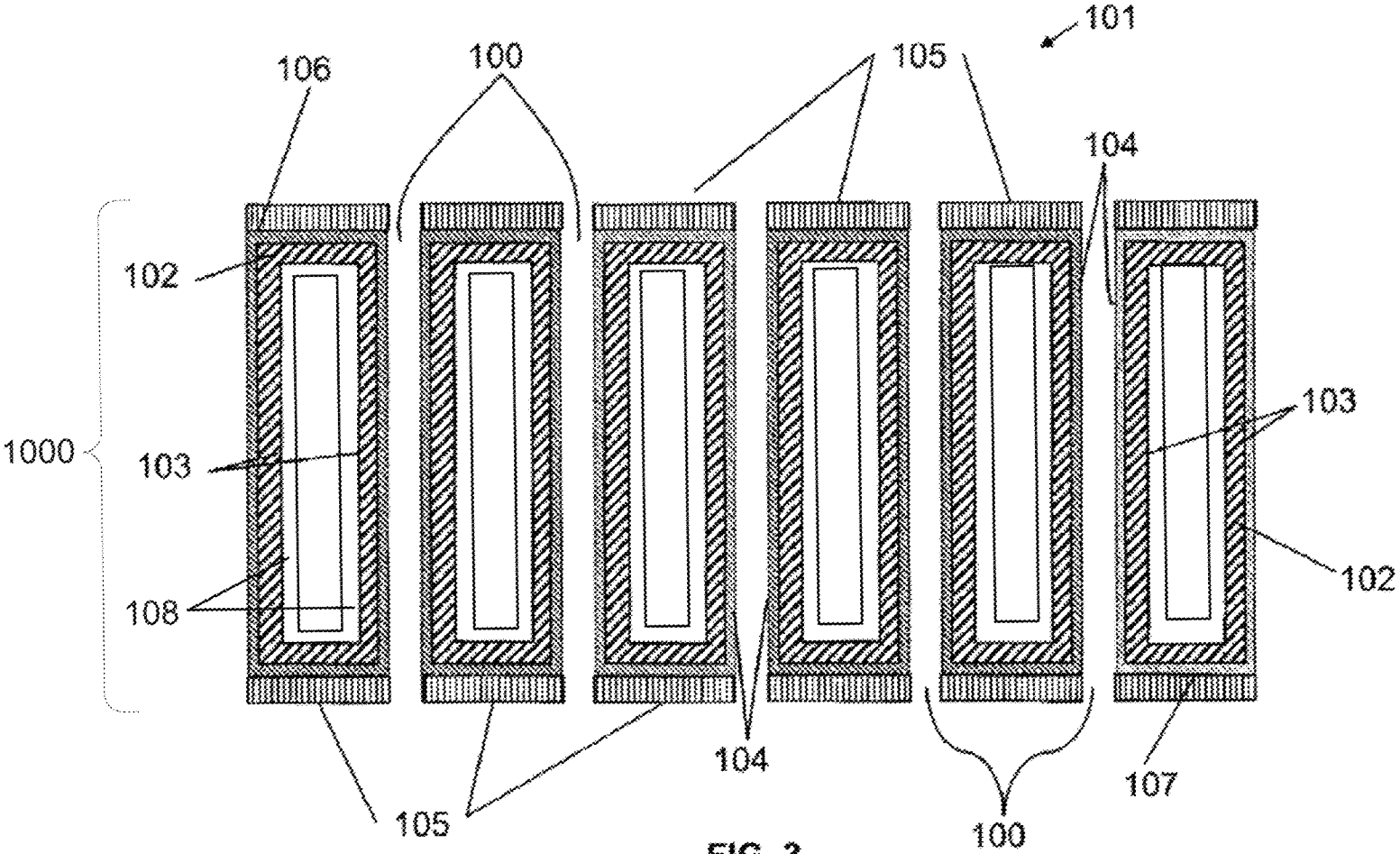
FIG. 3 is a cross-section across a plurality of MCP channels prepared according to the first embodiment.
Figure 4:
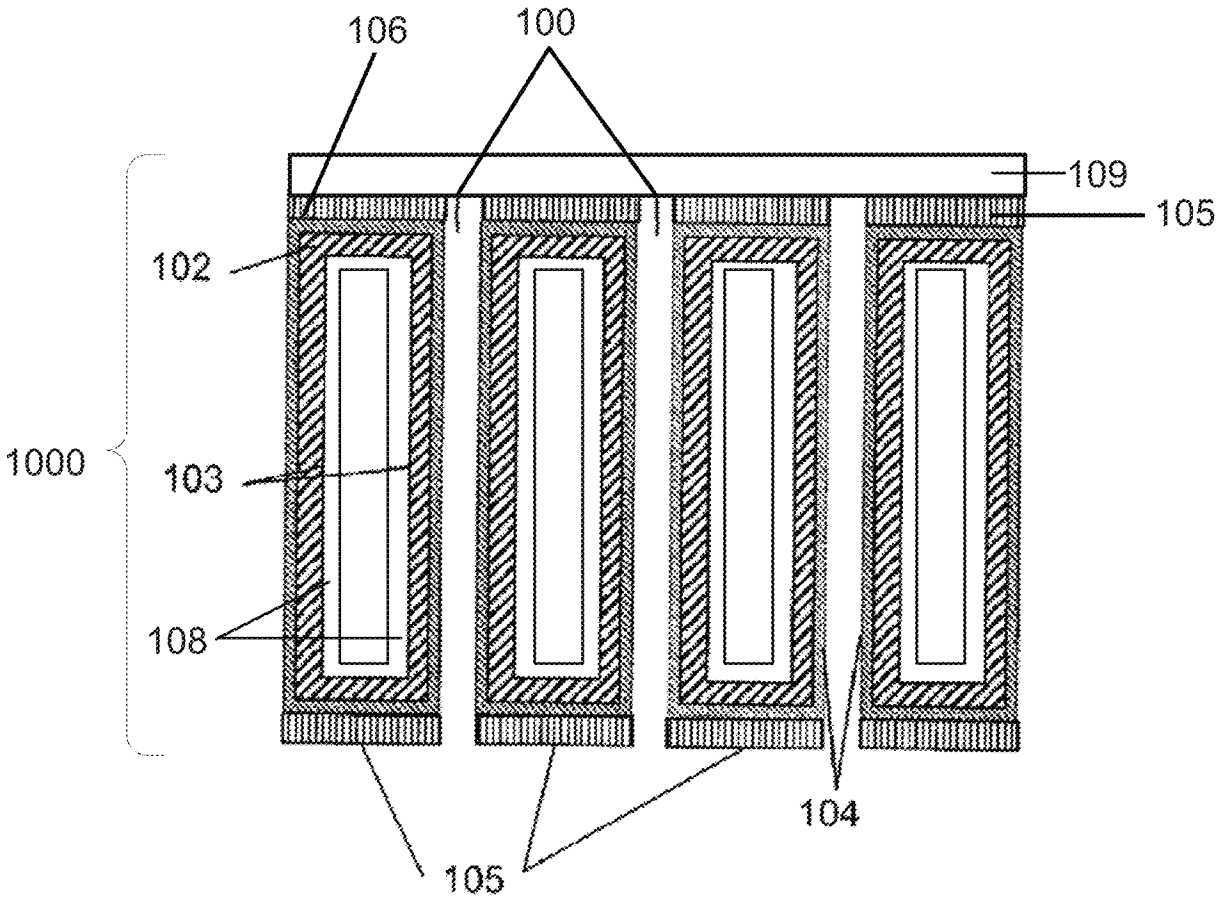
FIG. 4 is a cross-section across a plurality of MCP channels prepared according to a second embodiment of an enhanced electron amplifier structure.
Figure 8:
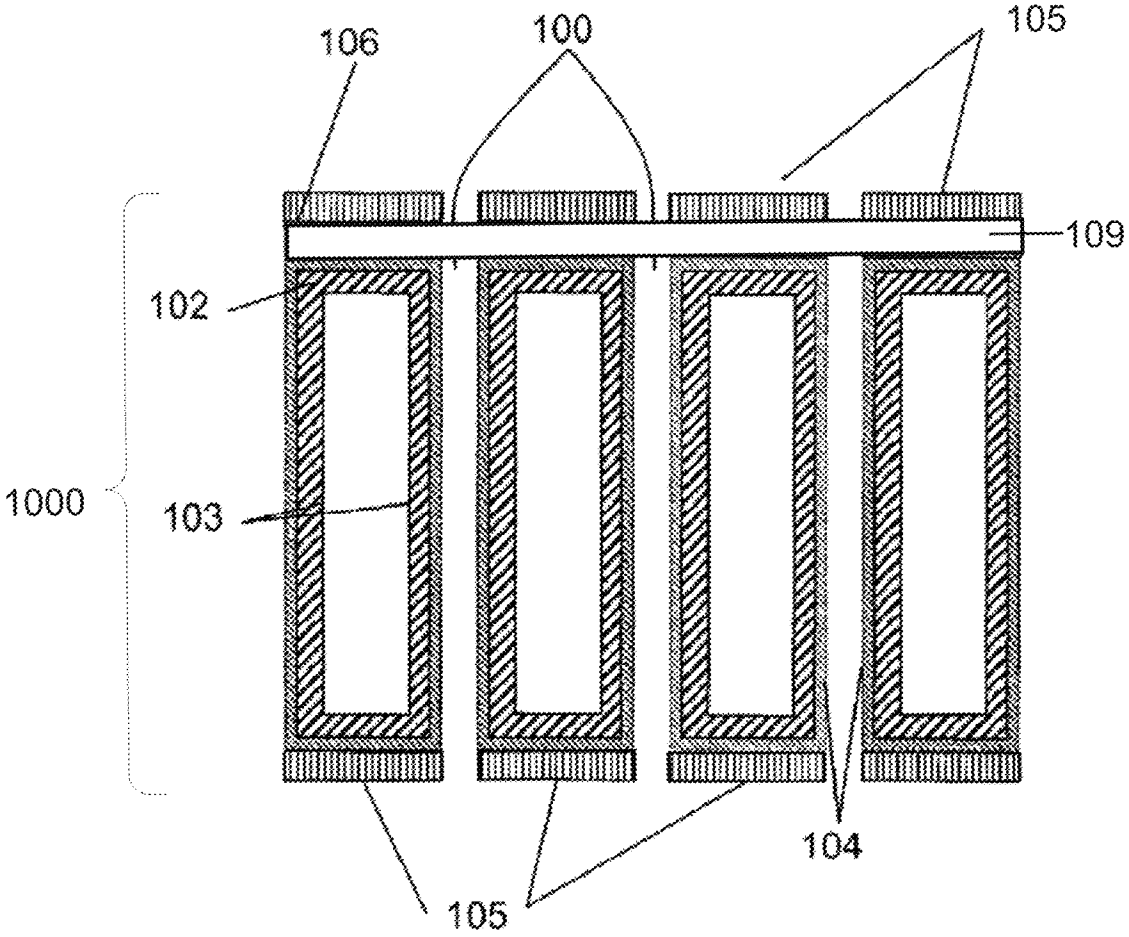
FIG. 8 is a cross-section across a plurality of MCP channels prepared according to the third embodiment of an enhanced electron amplifier structure.

Referring, in general, to the figures, in the embodiments of the present application, an enhanced electron amplifier structure 1000 includes a microporous substrate 101 having at least one channel 100. In each of the embodiments, the microporous substrate 101 includes a front surface 106, a rear surface 107, and a least one channel 100 extending through the microporous substrate between the front surface 106 and the rear surface 107. As depicted in FIGS. 3, 4, and 8, which illustrate a plurality of MCP channels 100 within the microporous substrate 101, a metal electrode 105 is deposited onto a front surface 106 and a rear surface 107 of the microporous substrate 101. The metal electrodes 105 may be deposited using techniques known in the art, including metal evaporation. The metal coating may be applied in such a way as to penetrate by a controlled distance into each of the pores. This process is known as end spoiling.

The microporous substrate 101 may be, for example, a microchannel substrate including, but not limited to, an active microchannel plate, a microchannel microelectromechanical device, a microsphere plate, an anodic aluminum oxide membrane, a microfiber plate, or a thin film functionalized microchannel plate.

First Embodiment

Figure 2A:
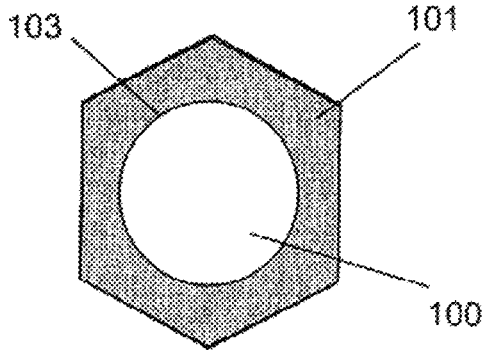
FIGS. 2A-2D are schematics of a cross-section through a single MCP channel (FIG. 2A) prepared according to a first embodiment of an enhanced electron amplifier structure utilizing CVD or ALD to deposit an ion diffusion layer on a channel surface (FIG. 2B), a resistive coating layer on the ion diffusion layer (FIG. 2C), and an emissive coating layer on the resistive coating layer (FIG. 2D).
Figure 2B:
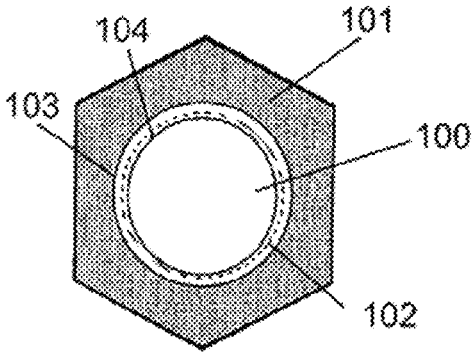
Figure 2C:
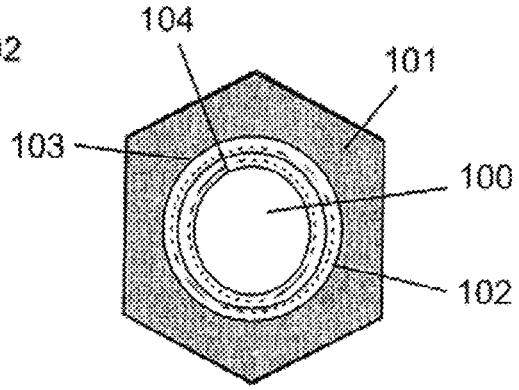
Figure 2D:
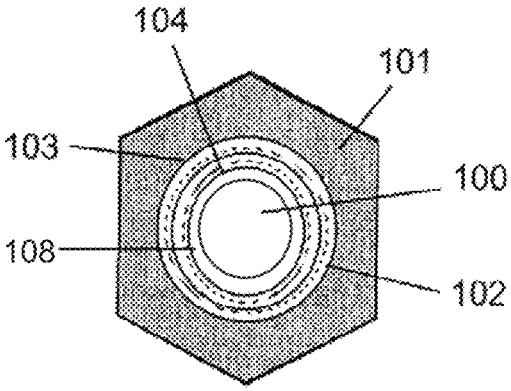

In a first embodiment of the enhanced electron amplifier structure 1000, the microporous substrate is a microchannel plate (MCP) substrate having at least one channel 100 extending therethrough. FIG. 2A depicts a schematic of a cross-section a single MCP channel 100 within a portion of a microporous substrate 101. In an initial step, an ion diffusion layer 102 is deposited onto the channel surface 103 (FIG. 2B). Next, a resistive coating layer 104 is deposited over the ion diffusion layer 102 (FIG. 2C). Subsequently, an emissive coating layer 108 (e.g., a secondary electron emission layer) is deposited over the resistive coating layer 104 (FIG. 2D). The ion diffusion layer 102, the resistive coating layer 104, and the emissive coating layer 108 may be independently deposited with high precision using various chemical deposition techniques, including chemical vapor deposition (CVD) and atomic layer deposition (ALD). In some examples, the ion diffusion layer 102 and the emissive coating layer 108 may be formed from the same materials (e.g., $Al_2O_3$, where the SEE coefficient $\delta$=2.5 to 3 for ALD $Al_2O_3$ 2-20 nm films). In other examples where higher $\delta$ values are needed, the ion diffusion layer 102 and the emissive coating layer 108 may be formed from different materials. For example, the ion diffusion layer 102 may be formed from $Al_2O_3$, and the emissive coating layer 108 may be formed from MgO, which has a SEE coefficient $\delta$=4 to 7. Electron gain (electron emission coefficient) also depends on the thickness of the layers. The emissive coating layer 108 is configured to release a large number of secondary electrons when a single electron strikes the surface thereof. This is how the electron amplification is performed.

The ion diffusion layer 102 serves the functions of 1) filling in the roughness of the glass substrate (from the etching step) so as to reduce the surface area and hence the volume of trapped residual gasses; and 2) providing a physical barrier that traps any alkali metal ions from diffusion to the MCP surface and exiting the MCP through electron stimulated desorption. The ion diffusion layer and the resistive layer can be one single layer so long as the resistive functions and ion diffusion functions are fulfilled by this single layer. In embodiments where the ion diffusion layer 102 and the resistive layer 104 are separate, then the ion diffusion layer 102 should be electrically insulating. In this case, the ion diffusion layer can be an electrically insulating metal oxide, metal nitride, or metal fluoride layer. For example, the ion diffusion layer 102 may be comprised of $Al_2O_3$, $HfO_2$, MgO, $TiO_2$, $ZrO_2$, $Si_3N_4$, $Gd_2O_3$, LiF, $AlF_3$, $MgF_2$, diamond and/or composites thereof. The ion diffusion layer 102 may be grown and deposited on the channel surface 103 by ALD or CVD in a predetermined thickness. This thickness may be in the range of 1-1000 nm, but preferably in the range of 10-100 nm. This layer should be sufficiently thick so as to fill in the surface roughness of the channel surface 103 (i.e., pore wall), but not so thick as to change the diameter of the channel 100 by more than ~1%. Normally, a thinner layer (e.g., 5-10 nm) is desirable.

FIG. 3 illustrates a microporous substrate 101 according to the first embodiment in which a plurality of channels 100 extend therethrough. The ALD process is capable of conformally coating the MCP including the internal channel surfaces within the substrate. ALD also provides precise composition control. Provision of the ion diffusion layer 102 suppresses the diffusion of the alkali metal ions present in the microporous substrate 101 such as $Ca^+$, $Na^+$, $K^+$, $Cs^+$, $Rb^+$, $B^+$, etc. from an inner portion of the channel wall to the channel surface 103. In one example, an ion diffusion layer 102 comprised of $Al_2O_3$ having a thickness of 20 nm was provided on a channel surface 103 of a bulk borosilicate glass microporous substrate 101 beneath the resistive coating layer 104 and the emissive coating layer 108. It is important for the ion diffusion layer 102 to be contamination free. The ion diffusion layer 102 may be deposited using thin film deposition methods that can produce a clean ion diffusion layer, for example, chemical processes such as ALD and CVD, or PVD process such as sputtering and MBE can produce a clean layer on the substrate. It is noted that PVD processes are not suitable for making 3D ion diffusion layer structures due to line of sight material growth. However, ALD and CVD may be used to create 3D ion diffusion layers.

In one experiment, provision of the ion diffusion layer prevented alkali metal ions (in this experiment, $Na^+$) from diffusing from an interior portion of the microporous substrate 101 to the channel surface 103, thereby preventing the Na+ metallic ions from dispersing in the resistive coating layer 104 and/or the emissive coating layer 108. Thus, no degradation of the MCP parameters was seen in the resistive coating layer 104 and the emissive coating layer 108, and the life of the MCP channel 100 was prolonged. In this experiment, the ion diffusion layer 102 was comprised of $Al_2O_3$, the resistive coating layer 104 was comprised of $Al_2O_3$, and the emissive coating layer 108 was comprised of MgO.

The resistive coating layer 104 is a blend of insulating and conductive components where the ratio of the components determines the resistivity of the system. Additionally, substantial control over the resistivity may be achieved by modulating the thickness of the resistive coating layer 104 within the channels. Using ALD, the resistive coating layer 104 is highly tunable, meaning the electrical resistance of the coating can be controlled by adjusting the composition of the resistive material. The desired resistivity of the resistive coating layer 104 may be achieved by selection of the insulating component and the conductive component and, in particular, the ratio of the components deposited on the MCP.

The resistive coating layer 104 comprises a composition of a conductive material and an insulating material that is thermally stable in an MCP detector environment. In various embodiments, the conductive material is a metal, a metal nitride, a metal sulfide, or a combination thereof. The conductive material may utilize more than one metal and/or metal nitride and/or metal sulfide. In particular embodiments, the conductive material may be one or more of: W, Mo, Ta, or Ti, or the nitrides thereof (i.e., WN, MoN, TaN, or TiN), or semiconducting metal sulfides (e.g., CdS, ZnS, $Cu_2S$, or $In_2S_3$). The conductive materials of the present embodiments demonstrate improved thermal stability for deployment in the resistive layer of the MCP detector relative to metal oxides that may be used as conductive components in conventional detectors. In particular, tunable resistance coatings prepared using the conventional metal oxides may have a negative temperature coefficient making these metal oxide materials susceptible to thermal runaway when deployed in a detector. Specifically, as the temperature of the detector increases, the resistance decreases causing more electrical current to flow, in turn further elevating the temperature. Additionally, conductivity stability of the present materials is enhanced relative to conventional metal oxides where conductivity varies significantly with environment, i.e., the gas sensor effect. Still further, the conductive materials may be deposited on the MCP at relatively low deposition temperatures of about 200° C. or lower.

The insulating material in the resistive coating layer 104 is a dielectric metal oxide, and in particular embodiments, may be one or more of: $Al_2O_3$, $HfO_2$, MgO, $TiO_2$, $Y_2O_3$, or $ZrO_2$. The insulating material may also be an oxide of the Lanthanide series or of the rare earth elements. In other embodiments, the insulating material comprises one or more Perovskites, including: $CaTiO_3$, $BaTiO_3$, $SrTiO_3$, $PbTiO_3$, lead zirconate titanate (PZT), lead lanthanum zirconate titanate (PLZT), lead magnesium niobate (PMN), $KNbO_3$, $K_xNa_{1-x}NbO_3$, or $K(Ta_xNb_{1-x})O_3$.

ALD of the resistive coating layer 104 may be accomplished by forming alternating discrete, continuous layers of the insulating component and discrete, continuous layers of the conductive component. Accordingly, the resistive coating layer 104 comprises a nanolaminate of a plurality of alternating continuous thin layers of the conductive component (the conductive component layer) and the insulating component (the insulating component layer). By forming discrete metallic domains that are continuous component layers rather than partial component layers, the resulting resistive coating layer 104 exhibits a positive temperature coefficient and improved thermal stability over that of a conventionally formed MCP. That is, increasing the temperature of the MCP will promote separation of the conductive and resistive domains as a result of the positive thermal expansion coefficient, and thereby decrease the electrical conductivity.

The emissive coating layer 108 is configured to produce a secondary electron emission responsive to an interaction with a particle received by the MCP channel. The emissive coating layer 108 may comprise various components, including various metal oxides, nitrides and sulfides, to obtain an amplified secondary electron emission in response to a low-level input. The secondary electron emission is detected downstream from the MCP. Like the resistive coating layer 104, the emissive coating layer 108 may be formed by ALD or CVD. In one embodiment, the emissive coating layer 108 comprises $Al_2O_3$. In various embodiments, multiple emissive coating layers 108 may be deposited within the MCP channel. The structure of MCP detector is substantially completed by metalizing the front and rear surfaces of the MCP to form the electrodes. In some embodiments, the metalizing electrode layer can be deposited on the front and rear surfaces of the MCP before the resistive and emissive coating layers are applied.

Second Embodiment

Referring to FIGS. 4-7, a second embodiment of the enhanced electron amplifier structure 1000 is the same as the first embodiment, except that in addition to the ion diffusion layer 102 being deposited onto the channel surface 103, an ion feedback layer 109 is deposited on a top surface of the metal electrode 105. In alternative implementations (not illustrated) the ion feedback layer 109 may be deposited on the front surface 106 (i.e., top surface of the microporous substrate 101) between the microporous substrate 101 and the metal electrode 105.

Figure 5:
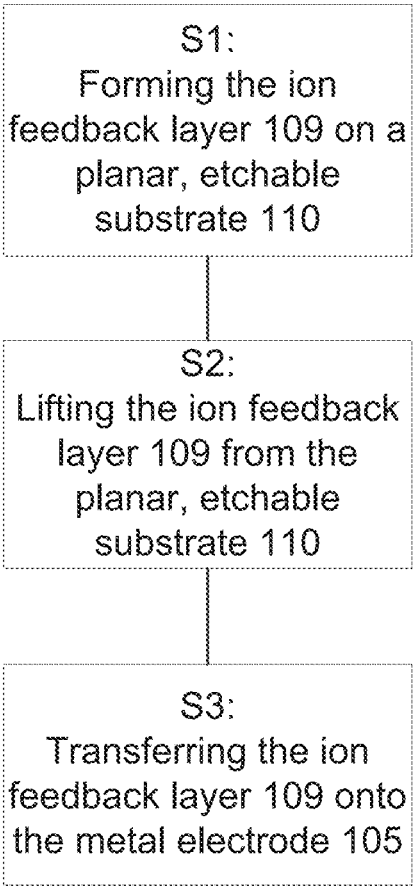
FIG. 5 is a flowchart illustrating a method of fabricating the ion feedback layer of FIG. 4 or FIG. 8.
Figure 6:
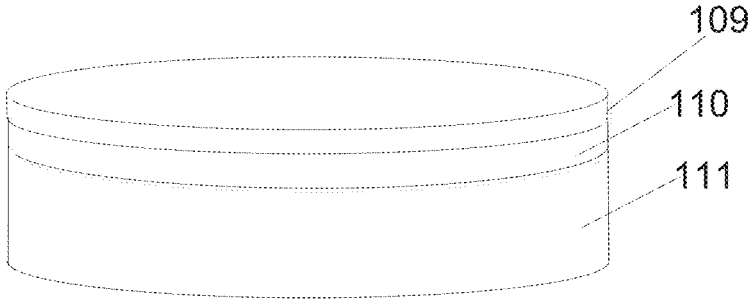
FIG. 6 illustrates a step of forming an ion feedback layer on a substrate, which corresponds to Step 1 in the flowchart of FIG. 5.

A method of fabricating the ion feedback layer 109 is shown in the flowchart of FIG. 5. The method of fabricating the ion feedback layer 109 includes a first step S1 of forming/growing the ion feedback layer 109. The ion feedback layer 109 has a predetermined secondary electron emission (SEE) coefficient (δ), which is the ratio of the number of secondary electrons emitted to the number of primary incident electrons.

The ion feedback layer 109 may be formed, for example, using chemical based thin film growth methods such as ALD, CVD, VPE, Sol gel, spray pyrolysis, etc., as well as physical vapor deposition (PVD) methods such as thermal evaporation MBE, sputtering, 3D printing, etc. The ion feedback layer 109 may be formed on a planar or structured/micro patterned etchable substrate 110 such as a wafer, a sacrificial etch layer, or a sacrificial etch layer formed on a wafer (see FIG. 6). The etchable substrate 110 may be supported by a supporting substrate 111. In one example, the supporting substrate 111 may be a Cu substrate, the etchable substrate 110 may be a CuOx native oxide provided on the supporting substrate 111, and the ion feedback layer 109 may be an $Al_2O_3$ layer. The $Al_2O_3$ layer may be deposited on the CuOx native oxide. Then, the ion feedback layer 109, the etchable substrate 110 and the supporting substrate 111 (see FIG. 6) may be exposed to dilute HCL solution, which dissolves/etches out the etchable substrate 110 (i.e., the CuOx) to release the ion feedback layer 109 from the supporting substrate 111 (see FIG. 7).

The ion feedback layer 109 is formed in a predetermined thickness, for example, 1-100 nm, preferably, 2-20 nm. A desired thickness of the ion feedback layer 109 depends on the energy of the incident electrons. A thicker ion feedback layer 109 will be more effective at ion suppression, and will last longer under ion bombardment, but will not be transmissive to lower energy electrons. However, higher energy electrons can better penetrate a thicker ion feedback layer 109. Forming the ion feedback layer 109 as described in the examples above allows for precise thickness and composition control over a large area (i.e., an electron amplifier structure).

In one example, the ion feedback layer 109 is comprised of $Al_2O_3$, MgO, $HfO_2$, $TiO_2$, $ZrO_2$, $Gd_2O_3$, LiF, $AlF_3$, $MgF_2$, diamond and/or composites thereof. In some examples, the ion feedback layer 109 is made of the same material as the ion diffusion layer 102. In other examples, the ion feedback layer 109 is made of a different material than the ion diffusion layer 102. The ion feedback layer 109 is deposited/grown on a planar or structured/micro patterned etchable substrate 110. The etchable substrate 110 may be an intermediate sacrificial etch layer (e.g., CuO, $SiO_2$, $Al_2O_3$, or a substrate with native oxide (e.g., a Cu foil substrate that has a native CuO substrate) that will be etched away when the ion feedback layer 109 is deposited on the microporous substrate 101. In one example, the ion feedback layer 109 is an $Al_2O_3$ layer that is deposited on an etchable substrate 110 such as a copper foil with native CuO layer, or CuO deposited on a Si wafer. The sacrificial etch layer may be selected according to the composition of the ion feedback layer 109 and the predetermined etch selectivity. For example, an etch rate of $Al_2O_3$ is greater than an etch rate of MgO.

Figure 7:
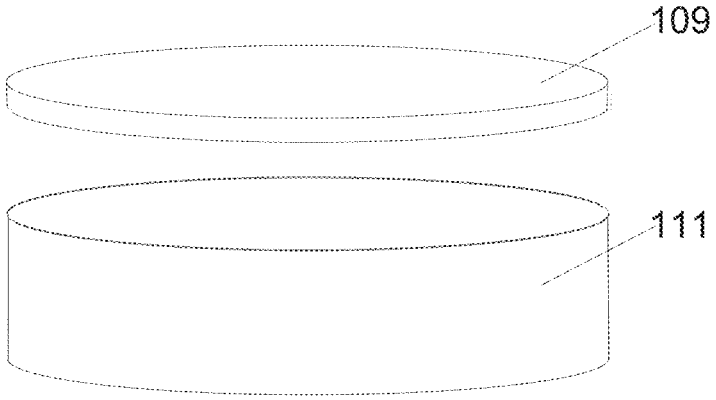
FIG. 7 illustrates a step of lifting the ion feedback layer from the substrate, which corresponds to Step 2 in the flowchart of FIG. 5.

The method of fabricating the ion feedback layer 109 includes a second step S2 of lifting the ion feedback layer 109 from the planar or structured/micro patterned etchable substrate 110 on which the ion feedback layer 109 was formed by dissolving or etching out the etchable substrate 110 (see FIG. 7). Lifting the ion feedback layer 109 from the etchable substrate 110 includes dunking the etchable substrate 110 having the ion feedback layer 109 thereon into an etching solution and selectively lifting or separating the ion feedback layer 109 from the etchable substrate 110. The etching solution may be, for example, diluted hydrochloric acid (HCl) solution. In other examples, different etchant solutions may be used, depending on the etch compatibility. Alternatively, the ion feedback layer 109 can be lifted or separated from the etchable substrate 110 by reactive ion etching or wet etching of the etchable substrate 110. The separated ion feedback layer 109 can be rinsed/cleaned. For example, the separated ion feedback layer 109 can be rinsed in a water bath at least one time to remove any remaining etching solution. The separated ion feedback layer 109 can be rinsed in a water bath multiple times.

Referring to the examples discussed in the first step S1, the $Al_2O_3$ layer deposited on the Cu foil substrate with native CuO layer (i.e., the etchable substrate 110) may be dunked in diluted hydrochloric acid solution, where an etch rate of CuO (i.e., the sacrificial etch layer) is greater than the etch rate of the $Al_2O_3$ layer. Thus, the CuO layer will be dissolved and the $Al_2O_3$ layer will be lifted or separated, and subsequently float on the etching solution. This floating $Al_2O_3$ layer can be rinsed/cleaned.

The method of fabricating the ion feedback layer 109 includes a third step S3 of transferring the separated ion feedback layer 109 onto the metal electrode 105 (see FIG. 4). The structural integrity (e.g., thickness, density and microstructure) and the pore opening walls where the ion feedback layer 109 will touch protect the ion feedback layer 109 from collapsing into the pores of the substrate 101. In order to transfer the ion feedback layer 109 onto the metal electrode 105, the microporous substrate 101 (including the metal electrode 105) is dipped in water and the separated ion feedback layer 109 is placed on the wet microporous substrate 101. The microporous substrate 101 and the ion feedback layer 109 are placed in an oven to dry, for example, for a duration of a few minutes to hours at a temperature ranging from 100° C. to 250° C. to remove any water trapped inside of the channels or pores of the microporous substrate 101. As discussed above, in other examples, the ion feedback layer 109 may be transferred onto the front surface 106 as opposed to the metal electrode 105. The heating may be performed in an inert atmosphere.

Figure 12:
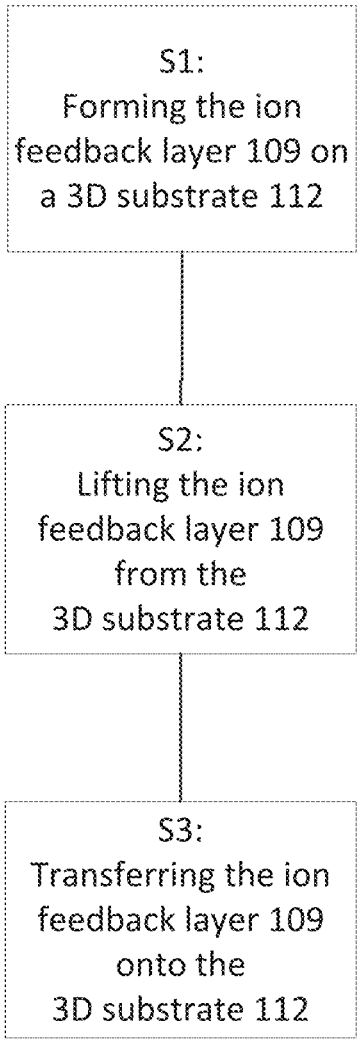
FIG. 12 is a flowchart illustrating an alternative method of fabricating the ion feedback layer of FIG. 4 or FIG. 8.

The method of fabricating the ion feedback layer 109 avoids problems associated with forming ion feedback layers on MCPs using polymeric films. In particular, it is known to form an $Al_2O_3$ layer on an MCP by depositing a polymeric film on the upper surface of the MCP such that the MCP pores are covered, and subsequently depositing the $Al_2O_3$ layer on an polymeric film. Deposition is performed by sputtering or ion assisted thin film growth methods, followed by burning, removal, and cleaning off of the polymer. This process is problematic because some of the sticky polymer enters the MCP pores, leaving very high C-contenting species (>15%) on the active surface of the pores (i.e., the channel surface), which results in ion feedback signal and degassing. The method of fabricating the ion feedback layer 109 described in FIGS. 5 and 12 (discussed in detail below) is an alternative clean method for depositing an ion feedback layer 109 on the upper surface 106 of the microporous substrate 101.

Third Embodiment

Referring to FIG. 8, a third embodiment is the same as the second embodiment, except that it does not include the ion feedback layer 102 deposited onto the channel surface 103. Instead, the resistive coating layer 104 is deposited directly onto the channel surface 103. Subsequently, the emissive coating layer 108 is deposited over the resistive coating layer 104. In the third embodiment, the ion feedback coating layer 109 is still deposited on the front surface 106 (i.e., top surface) of the microporous substrate 101. The details regarding the resistive coating layer 104 and the emissive coating layer 108 are the same as described in the first embodiment. The details regarding the ion feedback layer 109 are the same as described in the second embodiment.

Figure 9:
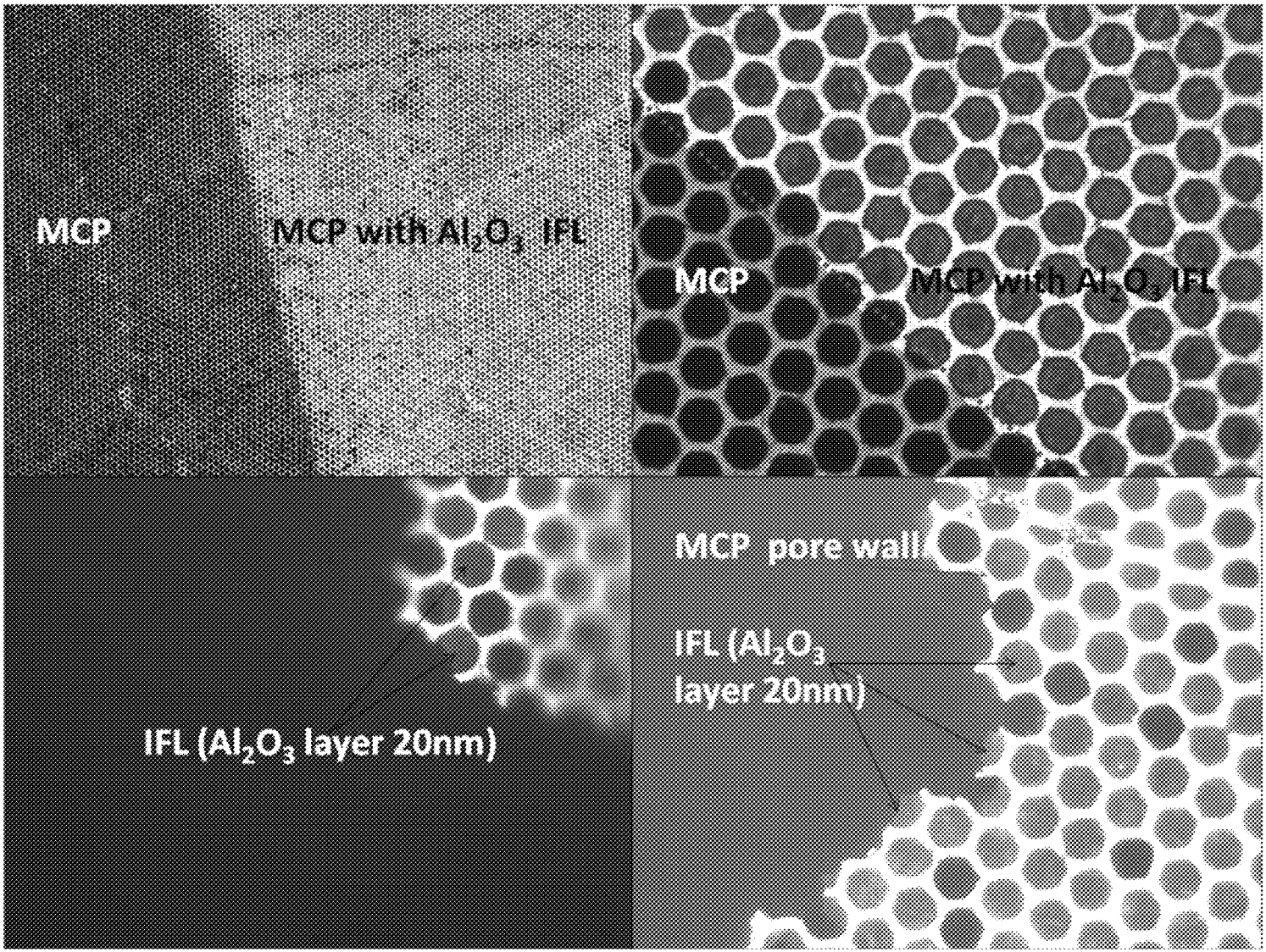
FIG. 9 illustrates the microporous substrate with and without the ion feedback layer on an upper surface thereof. The pore size is uniform. The ion feedback layer covers the pore openings.

FIG. 9 illustrates a top view of an example of the enhanced electron amplifier structure 1000 fabricated according to the second or third embodiment. In the example of FIG. 9, the microporous substrate 101 is an MCP. Each of the squares in FIG. 9 show the MCP with and without the ion feedback layer 109 (i.e., the $Al_2O_3$ layer). As seen in FIG. 9, the pore size within the microporous substrate 101 remains uniform, despite the provision of the ion feedback layer 109 on the front surface 106 thereof. In FIG. 9, the top left and right images are from the MCP with and without an ion feedback layer ($Al_2O_3$), which shows the MCP pores are blocked by the ion feedback layer layer. The bottom left and right images of FIG. 9 illustrate portion of the pores (complete and broken) that shows the ion feedback layer resting on the pores walls and free hanging when pores are broken.

Fourth and Fifth Embodiments

Figure 11:
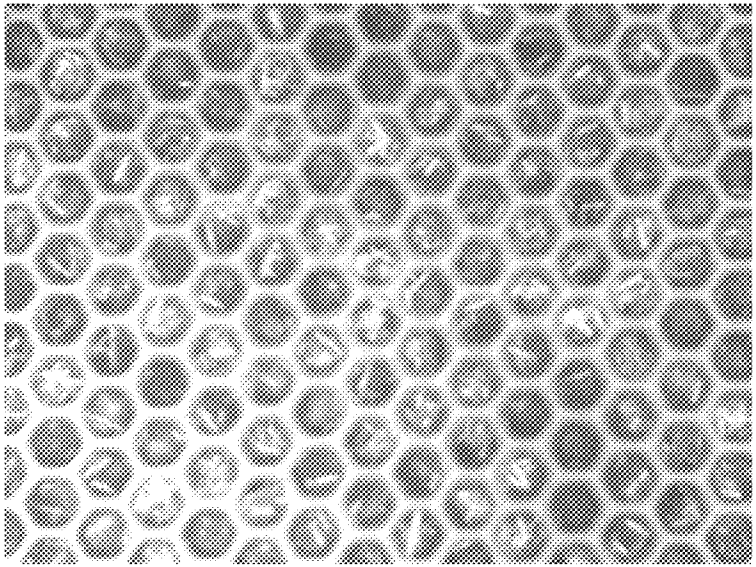
FIG. 11 illustrates the ion feedback layer formed on a three-dimensional substrate, which corresponds to Step 1 in the flowchart of FIG. 12 (described below).
Figure 10:
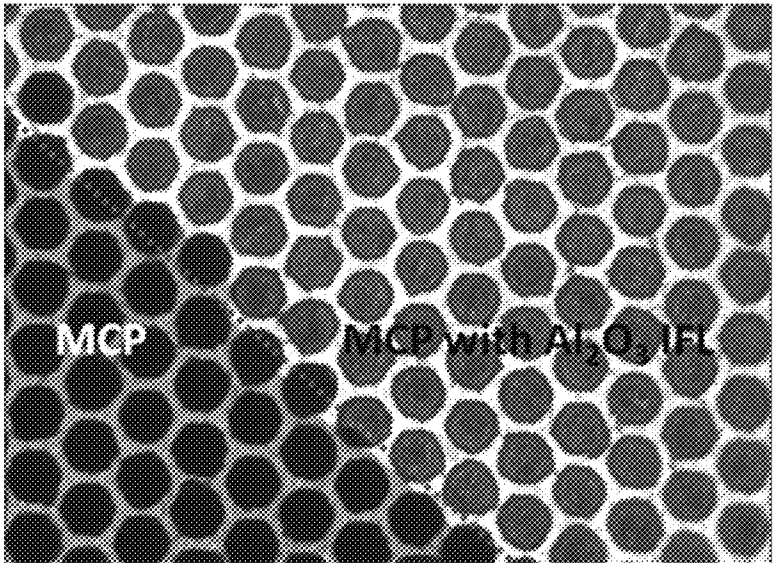
FIG. 10 illustrates the ion feedback layer formed on a two-dimensional substrate, which corresponds to Step 1 in the flowchart of FIG. 5.

In the second and third embodiments described above, the ion feedback layer 109 is a 2D thin film membrane (see FIG. 10). In a fourth and fifth embodiment, the ion feedback layer 109 of the second embodiment and the third embodiment, respectively, may be a 3D structure (see FIG. 11). A 2D ion feedback layer membrane may be enough to resolve the ion feedback issue, but an ion feedback layer having a 3D structure (e.g., a carbon nanotube or a rod) may provide additional advantages such as better defined first signal strike. Additionally, the 3D structure may absorb ions, but allow incoming electrons to pass. In the fourth and fifth embodiment, the method of fabricating the ion feedback layer 109 (see FIG. 12) includes a first step S1 of forming/growing the ion feedback layer 109. The ion feedback layer 109 has a predetermined secondary electron emission (SEE) coefficient (δ), which is the ratio of the number of secondary electrons emitted to the number of primary incident electrons.

Figure 13:
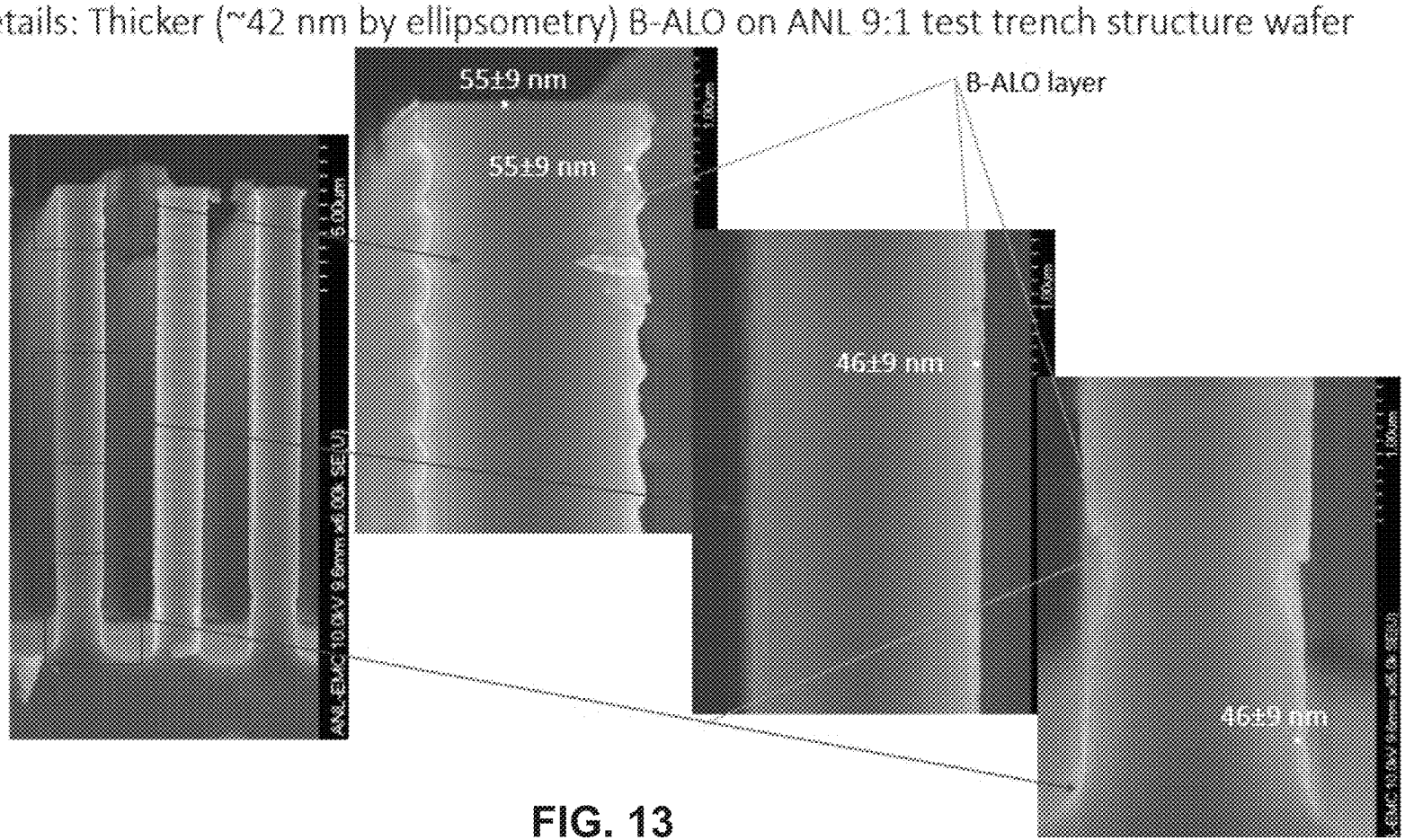
FIG. 13 illustrates one example in which the ion feedback layer 109 is B—$Al_2O_3$, and is deposited on a 3D structure (e.g., a trench wafer).

The ion feedback layer 109 may be formed, for example, using chemical based thin film growth methods such as ALD, CVD, VPE, Sol gel, spray pyrolysis, etc., as well as physical vapor deposition (PVD) methods such as thermal evaporation MBE, sputtering, 3D printing, etc. In contrast to the second and third embodiments in which the ion feedback layer 109 was formed/grown on a planar etchable substrate 110, in the fourth and fifth embodiments, the ion feedback layer 109 is formed on a 3D substrate 112 (see FIGS. 11 and 12). FIG. 13 illustrates one example in which the ion feedback layer 109 is B—$Al_2O_3$, and is deposited on a 3D structure (e.g., a trench wafer).

For example, the 3D substrate 112 may be a substrate having microfibers disposed on an upper surface thereof (e.g., glass microfiber filter) or a lithographically structured substrate. The ion feedback layer 109 may be comprised of the same materials described in the second embodiment, the only difference being the type of substrate on which ion feedback layer 109 is formed/grown. The method of fabricating the ion feedback layer 109 includes a third step S3 of transferring the separated ion feedback layer 109 onto the microporous substrate 101 (i.e., the electron amplifier structure).

The method of fabricating the ion feedback layer 109 includes a second step S2 of lifting the ion feedback layer 109 from the 3D substrate 112. This is accomplished by exfoliation.

The construction and arrangements of the methods of fabricating enhanced electron amplifier structures and the electron amplifier structures including an ion feedback layer, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, image processing and segmentation algorithms, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

With respect to the use of substantially any plural and/or singular terms herein, those having skill in the art can translate from the plural to the singular and/or from the singular to the plural as is appropriate to the context and/or application. The various singular/plural permutations may be expressly set forth herein for the sake of clarity.

What is claimed:

1. A method of fabricating an enhanced electron amplifier structure, the method comprising:

providing a microporous substrate, the microporous substrate having a front surface and a rear surface and at least one channel extending through the microporous substrate between the front surface and the rear surface;

depositing a surface of the channel within the microporous substrate with an ion diffusion layer, the ion diffusion layer comprising a metal oxide;

depositing a surface of the ion diffusion layer with a resistive coating layer;

depositing a surface of the resistive coating layer with an emissive coating layer, the emissive coating layer configured to produce a secondary electron emission responsive to an interaction with a particle received by the channel;

depositing an ion feedback layer on the front surface of the microporous substrate by:

forming the ion feedback layer on a sacrificial substrate in a predetermined thickness;

separating the ion feedback layer from the sacrificial substrate; and transferring the separated ion feedback layer onto the front surface of the microporous substrate, wherein:

the ion diffusion layer, the resistive coating layer, and the emissive coating layer are independently deposited via chemical vapor deposition or atomic layer deposition, and the substrate on which the ion feedback layer is formed is a three-dimensional substrate comprising a surface having features protruding from the surface.

2. The method of claim 1, wherein the ion feedback layer is formed on the substrate using a chemical based thin film growth method or a physical vapor deposition method.

3. The method of claim 1, wherein the substrate is an etchable substrate, and wherein separating the ion feedback layer from the etchable substrate comprises dunking the etchable substrate having the ion feedback layer formed thereon into an etching solution that selectively etches the etchable substrate to separate the ion feedback layer from the etchable substrate.

4. The method of claim 3, wherein the ion feedback layer is comprised of $Al_2O_3$;

wherein the etchable substrate is comprised of a Cu foil substrate with native CuO layer; and wherein the etching solution is comprised of diluted hydrochloric acid solution.

5. The method of claim 1, wherein separating the ion feedback layer from the three-dimensional substrate is carried out by exfoliation.

6. The method of claim 1, further comprising rinsing the separated ion feedback layer with water prior to transferring the ion feedback layer onto the microporous substrate.

7. The method of claim 6, wherein transferring the ion feedback layer onto the microporous substrate comprises:

wetting at least the upper surface of the substrate with water;

placing the ion feedback layer onto the upper surface of the water; and heating the substrate having the ion feedback layer placed thereon to remove the water.

8. The method of claim 1, further wherein the front surface comprises an electrode; and the separated ion feedback layer is transferred on to the electrode of the front surface.

9. A method of fabricating an enhanced electron amplifier structure, the method comprising:

providing a microporous substrate, the microporous substrate having a front surface and a rear surface and at least one channel extending through the microporous substrate between the front surface and the rear surface;

depositing a surface of the channel within the microporous substrate with an ion diffusion layer, the ion diffusion layer comprising a metal oxide;

depositing a surface of the ion diffusion layer with a resistive coating layer; and depositing a surface of the resistive coating layer with an emissive coating layer, the emissive coating configured to produce a secondary electron emission responsive to an interaction with a particle received by the channel;

forming an ion feedback layer on the front surface of the microporous substrate by:

forming the ion feedback layer on a sacrificial substrate in a predetermined thickness;

lifting the ion feedback layer from the sacrificial substrate; and transferring the ion feedback layer onto an upper surface of the microporous substrate by:

wetting at least the upper surface of the substrate with water;

placing the ion feedback layer onto the upper surface of the water; and heating the substrate having the ion feedback layer placed thereon to remove the water, wherein the ion diffusion layer, the resistive coating layer, and the emissive coating layer are independently deposited via chemical vapor deposition or atomic layer deposition.

10. A method of fabricating an enhanced electron amplifier structure, the method comprising:

providing a microporous substrate, the microporous substrate having a front surface and a rear surface and at least one channel extending through the microporous substrate between the front surface and the rear surface;

depositing a surface of the channel within the microporous substrate with an ion diffusion layer, the ion diffusion layer comprising a metal oxide;

depositing a surface of the ion diffusion layer with a resistive coating layer;

depositing a surface of the resistive coating layer with an emissive coating layer, the emissive coating layer configured to produce a secondary electron emission responsive to an interaction with a particle received by the channel;

depositing an ion feedback layer on the front surface of the microporous substrate by:

forming the ion feedback layer on a sacrificial substrate in a predetermined thickness;

separating the ion feedback layer from the sacrificial substrate;

rinsing the separated ion feedback layer with water prior to transferring the ion feedback layer onto the microporous substrate; and transferring the separated ion feedback layer onto the front surface of the microporous substrate by:

wetting at least the upper surface of the substrate with water;

placing the ion feedback layer onto the upper surface of the water; and heating the substrate having the ion feedback layer placed thereon to remove the water, wherein the ion diffusion layer, the resistive coating layer, and the emissive coating layer are independently deposited via chemical vapor deposition or atomic layer deposition.

* * * * *